United States Patent [19]

Ebato et al.

[11] Patent Number: 4,995,184

[45] Date of Patent: Feb. 26, 1991

[54] PASSBOOK PAGE TURNING MECHANISM

[75] Inventors: Ken Ebato, Yokohama; Susumu Sato, Ninomiya, both of Japan

[73] Assignee: NCR Corporation, Dayton, Ohio

[21] Appl. No.: 432,254

[22] Filed: Nov. 6, 1989

[30] Foreign Application Priority Data

Apr. 28, 1989 [JP] Japan ..... 1-107927

[51] Int. Cl.[5] ..... G09F 19/00; B41F 19/00; B41J 13/00

[52] U.S. Cl. ..... 40/531; 40/475; 101/296; 902/19

[58] Field of Search ..... 400/25, 28, 634, 636; 40/475, 531; 101/296; 84/487; 902/19

[56] References Cited

U.S. PATENT DOCUMENTS 4,488,367 12/1984 Yamauchi et al. ..... 40/531
4,545,141 10/1985 Ito et al. ..... 40/531
4,600,828 7/1986 Nogami et al. ..... 902/19
4,700,497 10/1987 Sato et al. ..... 40/531

*Primary Examiner*—Edgar S. Burr

*Assistant Examiner*—C. A. Bennett

*Attorney, Agent, or Firm*—Wilbert Hawk, Jr.; Albert L. Sessler, Jr.; George J. Muckenthaler

[57] ABSTRACT

A passbook page turning mechanism includes independently movable and spaced upper rollers and independently movable and spaced lower rollers which are vertically movable and which grip the passbook and move the passbook from a printing station to a page turning station. A pair of upper and lower longitudinally movable rollers serve as apparatus to turn the pages of the passbook. At the page turning station, a lower roller of the pair of rollers is raised to flex the passbook and an upper roller of the pair of rollers is rotated to turn the page and to complete the page turning operation after which the passbook is moved to the printing station. The lower roller of the pair of rollers is also displaceable in the longitudinal direction from the upper roller of the pair of rollers. The mechanism also provides for turning one or more pages in the opposite direction from the direction of a normal page turning operation.

8 Claims, 6 Drawing Sheets

PASSBOOK PAGE TURNING MECHANISM

CROSS REFERENCE TO RELATED APPLICATIONS

Passbook Transport Mechanism, copending application Ser. No. 432,435, filed Nov. 6, 1989, invented by Yasushi Nakamura and Junnosuke Takeda and assigned to NCR Corporation.

Passbook Read/Write Mechanism, copending application Ser. No. 432,120, filed Nov. 6, 1989, invented by Shingo Watanabe and Shohei Murakami and assigned to NCR Corporation.

BACKGROUND OF THE INVENTION

In the field of financial-type business transactions, a commonly used record medium is a passbook or bankbook for maintaining a record of each transaction. The passbook is inserted into a business machine for reading the contents of the passbook, for printing information or data in the passbook, and for recording the printed information or data in the passbook.

In the operation of the business machine for passbook printing therein, the passbook is inserted at the front of the machine and the passbook is then transported or conveyed past a printing station toward the rear of the machine where the current status of the record is read by means of read/write mechanism from a magnetic stripe on the passbook. The passbook is then transported to the printing station for printing operation after which the passbook is again transported toward the rear of the machine where the printed information is recorded by means of the read/write mechanism in a write operation on the magnetic stripe. The passbook is then transported toward the front and out of the business machine.

In prior mechanisms there have been at least two types of means for conveying a printed medium such as a passbook or a handbook to predetermined positions in a printer or other business machine to enable the required operations. One type of conveying means uses pairs of rollers spaced from each other and disposed at spaced intervals along the path of the handbook and which rollers are rotatably engaged with the handbook. Another type uses rollers provided on both sides of a feed path and includes belts driven by the rotating rollers and engageable with the handbook. Along with the rollers utilized for conveying the handbook to different locations in the printer is apparatus or mechanism for turning the pages of the handbook.

Representative documentation in the field of page turning apparatus includes U.S. Pat. No. 4,545,141, issued to M. Ito et al. on Oct. 8, 1985, which discloses automatic document page turning apparatus having a rotating drive roller and feed means for moving the document to a page turning position.

U.S. Pat. No. 4,600,828, issued to M. Nogami et al. on July 15, 1986, discloses a system for issuing passbooks which has a page-turning mechanism for opening the cover and the inner pages of the passbook prior to a printing operation.

U.S. Pat. No. 4,700,497, issued to S. Sato et al. on Oct. 20, 1987 discloses automatic page turning apparatus that turns a page to a partially turned position and includes detection means and control means operable for subsequently completing turning of the page.

SUMMARY OF THE INVENTION

The present invention relates to mechanism for conveying or transporting a passbook and more particularly to mechanism for turning the pages of the passbook.

In accordance with the present invention there is provided page turning mechanism comprising means for feeding a multiple-page record medium along a feed path toward a page turning station, the feeding means having opposed gripping members for gripping the record medium while feeding thereof along the feed path, means for moving said opposed gripping members from a first position to the page turning station, and means comprising movable rollers positioned at said page turning station, one of said rollers being movable in a direction along said feed path in a first direction to a predetermined position, the other roller being movable in a direction toward said record medium so as to effect a bowed condition thereof, said one roller being movable from said predetermined position in a direction opposite said first direction along said feed path for completing the turning of one page of said record medium.

In accordance with the above discussion, a principal object of the present invention is to provide a page-turning mechanism for use with a multiple-page record medium.

Another object of the present invention is to provide a page-turning mechanism for turning a page of a multiple-page record medium in a forward page turning operation and for turning a page of such record medium in a backward page turning operation.

An additional object of the present invention is to provide roller means for gripping a record medium in unprinted areas thereof while turning a page of a multiple-page record medium.

A further object of the present invention is to provide an improved mechanism for turning pages of a record medium wherein the mechanism serves to transport the record medium and also to turn the pages of the medium thereby minimizing the distance required for transporting the record medium.

Additional advantages and features of the present invention will become apparent and fully understood from a reading of the following description taken together with the annexed drawing.

DESCRIPTION OF THE PREFERRED EMBODIMENT

Figure 1A:
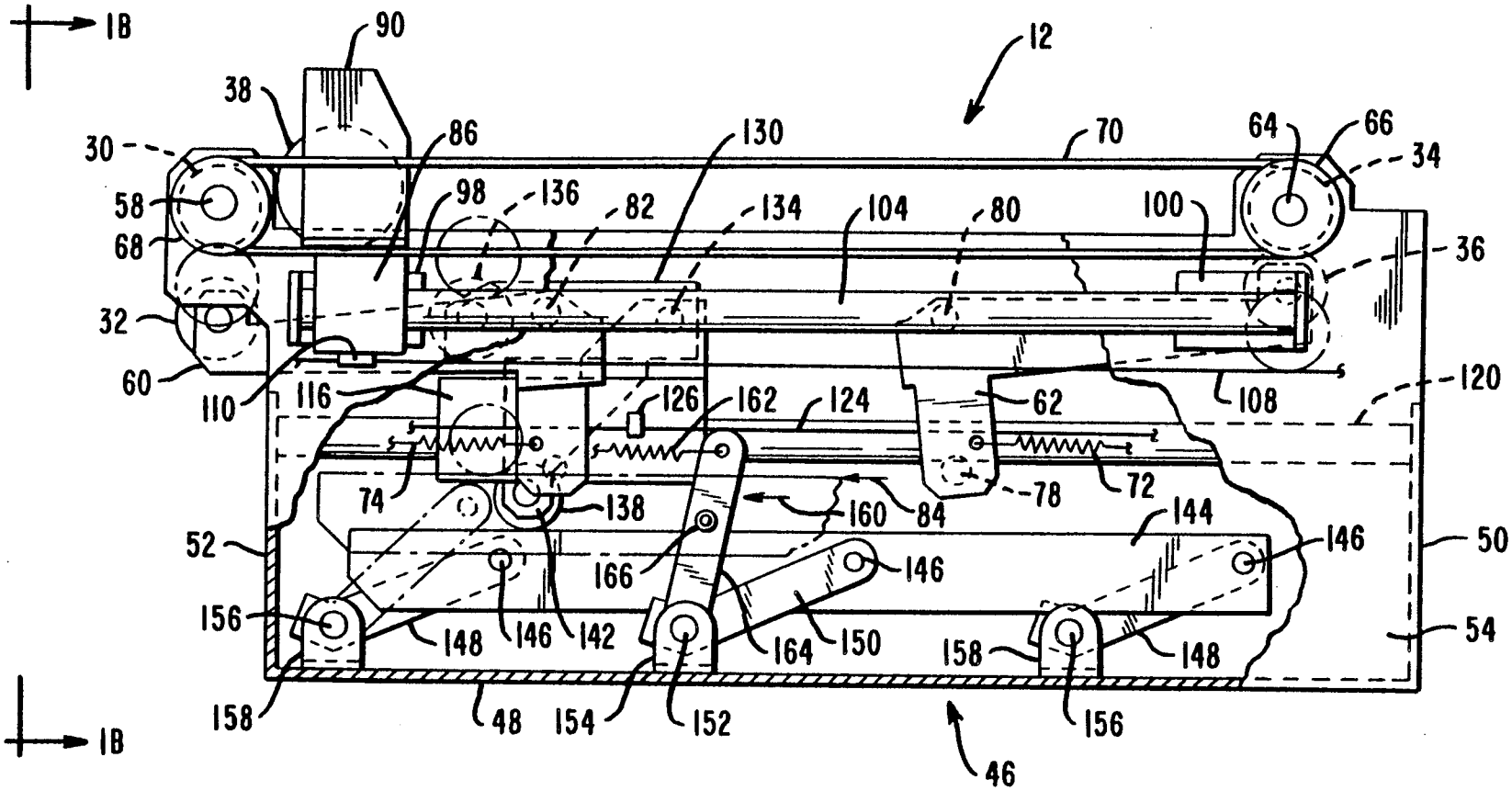
FIG. 1A is a side elevational view incorporating the subject matter of a preferred embodiment of the present invention.
Figure 1B:
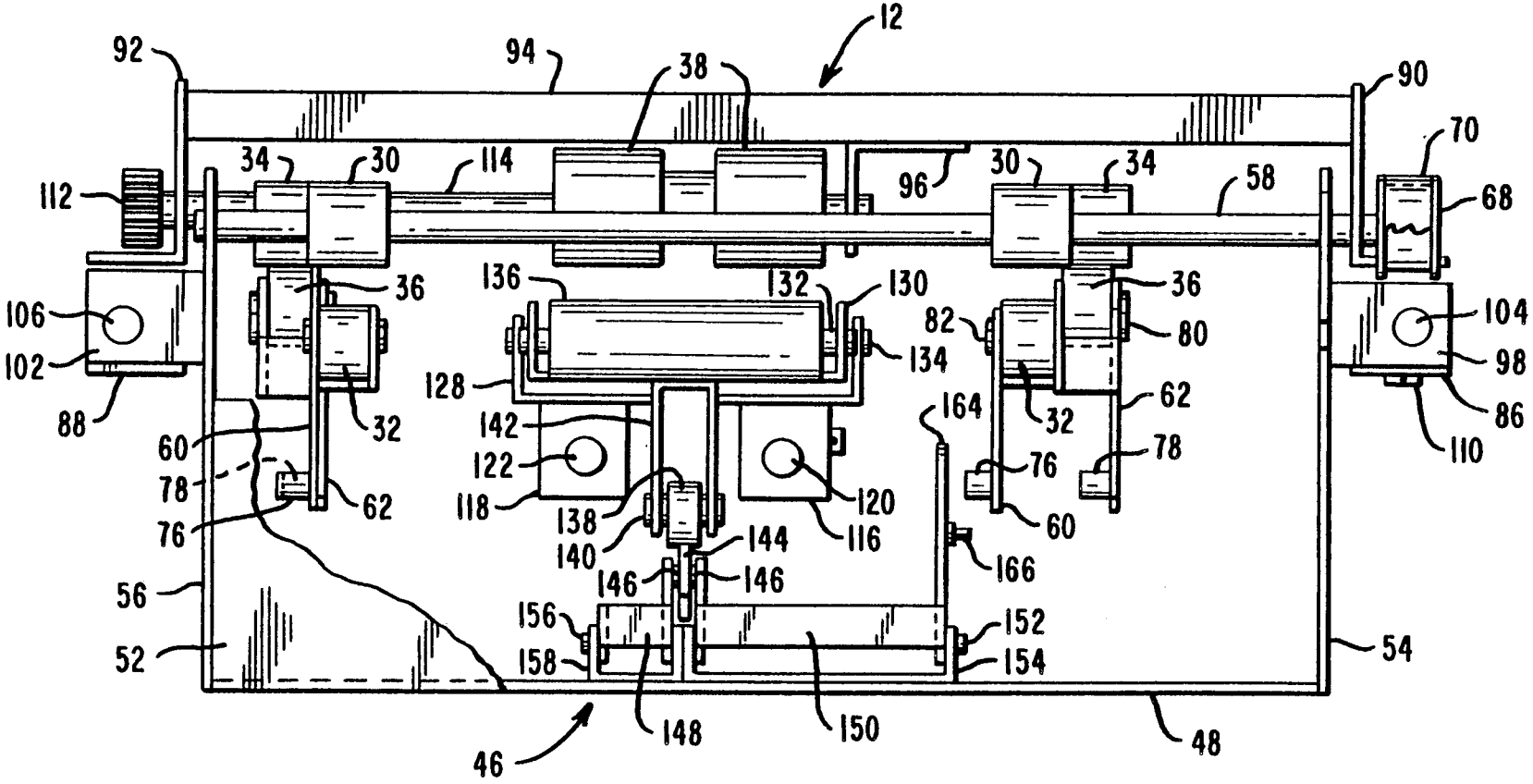
FIG. 1B is a front elevational view taken on the line 1B—1B of FIG. 1A.
Figure 2:
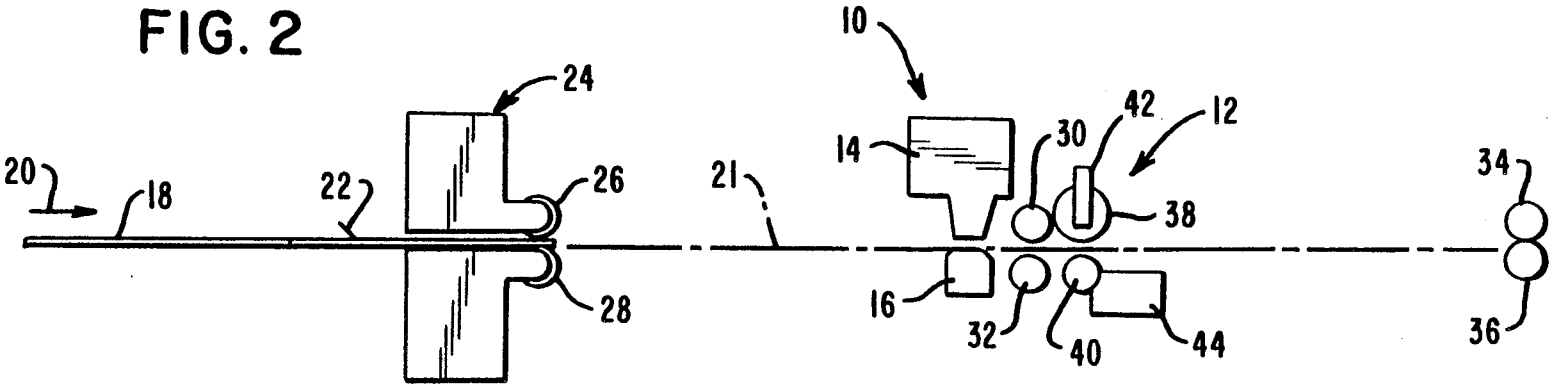
FIG. 2 PRIOR ART
FIG. 2 is a side view in schematic form showing the passbook transporting apparatus.

Referring now to FIGS. 1A, 1B and 2, FIG. 2 shows an arrangement of a printing mechanism 10 and a page turning mechanism 12 of a business machine used for financial transactions. The printing mechanism 10 occupies a printing section at the front of the machine (toward the left side in FIG. 2) and the page turning mechanism 12 occupies a page turning section or area at the rear of the machine (toward the right side in FIG. 2). The printing mechanism 10 includes a print head 14 and a platen 16 positioned for printing on a record medium 18 in the form of a passbook which is inserted into the business machine through an entrance port 22 in the direction of the arrow 20. The passbook 18 is transported along a feed path 21.

A record medium or passbook gripping apparatus 24 includes a pair of opposed rollers 26 and 28 which are rotatably supported and adapted to be movable along the feed path of the record medium 18 in a direction toward the printing mechanism 10. The details of the gripping apparatus and the passbook transport mechanism are described in a copending application, Ser. No. 432,435. A pair of opposed rollers 30 and 32 are suitably journaled and are positioned at the left end of the page turning section or area between the printing mechanism 10 and the page turning mechanism 12. A like pair of opposed rollers 34 and 36 are suitably journaled and are positioned at the right end of the page turning section or area which is at the rear of the business machine.

The page turning mechanism 12 includes an upper roller 38 which is suitably journaled for rotation and is suitably supported by supporting structure 42. The structure 42 is arranged to be movable along the feed path of the record medium 18 between the left end rollers 30 and 32 and the right end rollers 34 and 36. A lower roller 40 is suitably journaled for rotation and is suitably supported by supporting structure 44. The structure 44 is also arranged to be movable along the feed path of the record medium 18 and additionally is designed to move the lower roller 40 in a vertical direction toward and from the upper roller 38. The upper roller 38 is larger in diameter than the lower roller 40 and has a frictional coating (such as rubber or the like) on approximately one-half the circumference thereof.

Referring now to FIGS. 1A and 1B which illustrate details of the page turning mechanism 12, an enclosure or frame 46 includes a base portion 48, end frames or portions 50 and 52 (FIG. 1A), and side frames or portions 54 and 56 (FIG. 1B). FIG. 1A shows the opposed rollers 30 and 32 at the left side thereof and the opposed rollers 34 and 36 at the right side thereof. FIG. 1B shows one roller 30 supported on a shaft 58 near the right end thereof and the other roller 30 supported on the shaft 58 near the left end. The shaft 58 is suitably journaled in the side frames 54 and 56 at the front of the page turning area of the printer 10. FIG. 1B also shows the rollers 32 positioned under the rollers 30, and each roller 32 is suitably journaled for rotation and is supported by a respective arm 60. One roller 34 is supported on a shaft 64 (FIG. 1A) near the right end thereof and a like roller 34 is supported on the shaft 64 near the left end (FIG. 1B). The shaft 64 is suitably journaled in the side frames 54 and 56 at the rear of the page turning area of the printer 10. The rollers 36 are positioned under the rollers 34 and each roller 36 is suitably journaled for rotation and is supported by a respective arm 62.

A pulley 66 (FIG. 1A) is secured to one end of the shaft 64 at the rear of the page turning area and a pulley 68 is secured to one end of the shaft 58 at the front of such page turning area. A belt 70 is trained around the pulleys 66 and 68 and is suitably driven by a stepper motor or the like (not shown). The pulleys 66 and 68 are positioned outside the wall 54 (FIG. 1B) so as to be out of the feed path of the record medium 18.

A spring 72 (FIG. 1A) is connected to a downwardly extending portion of the arm 62 and to a suitable portion of the frame of the machine for biasing the roller 36 in an upward direction to engage with the roller 34. A like spring 74 is connected to a downwardly extending portion of the arm 60 and to a suitable portion of the frame of the machine for biasing the roller 32 in an upward direction to engage with the roller 30. A stud 76 is fixed to the arm 60 (FIG. 1B) and a stud 78 is fixed to the arm 62 near the right side of the printer 10. A similar stud 76 is fixed to an arm 60 and a similar stud 78 is fixed to an arm 62 near the left side of the printer 10. The arm 62 is adapted to be rotated in the clockwise direction (FIG. 1A) on a pivot 80 by a solenoid or like actuator (not shown). Operation of the solenoid in the direction of the arrow 84 causes the roller 36 to be moved downwardly and away from the roller 34. At this time no force is acting on the stud 76 of arm 60 so that the arm 60 is urged by the spring 74 in a clockwise direction (FIG. 1A) to raise the roller 32 into engagement with the roller 30. On the other hand, when the arm 60 is pulled in the opposite direction by a solenoid or like actuator (not shown), the operation is performed in the opposite manner and the roller 32 is lowered and the roller 36 is raised. In this manner the roller 32 and the roller 36 move in opposite directions in the vertical movements of such rollers.

As mentioned above, FIG. 2 shows the upper roller 38 and the lower roller 40 opposed to each other. The upper roller 38 is journaled for rotation and is movable along the feed path of the record medium 18. The lower roller 40 is also journaled for rotation and is movable along the record medium feed path and is also movable in a direction toward and from the upper roller 38. The upper roller 38 and the lower roller 40 comprise a part of the record medium conveying or transporting apparatus and comprise a part of the page turning mechanism 12 that operates in the page turning section or area of the business machine. The rollers 38 and 40 are arranged and operated to grip the record medium 18 and convey or transport such medium along the feed path. The upper conveying apparatus includes the roller 38 and the supporting structure 42 along with means for moving the conveying apparatus. The support structure 42 includes a right carriage 86 (FIG. 1B) and a left carriage 88 supporting L-shaped brackets 90 and 92. A cross strut 94 is connected to the brackets 90 and 92 and an L-shaped bracket 96 is secured to the strut 94 near the center thereof and extends downwardly therefrom.

An L-shaped bracket 98 is secured to the side wall 54 (FIG. 1B) at the front thereof and an L-shaped bracket 100 is secured to the side wall 54 at the rear thereof (FIG. 1A). An L-shaped bracket 102 is secured to the side wall 56 at the front thereof and an L-shaped bracket (not shown but similar to bracket 100) is secured to the side wall 56 at the rear thereof. A guide rod or shaft 104 (FIG. 1A) is secured to the brackets 98 and 100 on the right side of the enclosure 46 and a guide rod or shaft 106 (FIG. 1B) is secured to the brackets on the left side of the enclosure. The right carriage 86 is slidable along the guide shaft 104 and the left carriage 88 is slidable along the guide shaft 106. A driving wire or cable 108 (FIG. 1A) is secured to a bracket 110 fixed to the bottom of the right carriage 86 and the cable is driven by means of a stepper motor (not shown) to move the carriages 86 and 88 in fore-and-aft direction along the respective guide shafts 104 and 106. A gear 112 (FIG. 1B) is secured to the left end of a shaft 114 which is journaled in the bracket 92 at the left side of the enclosure 46 and is journaled in the L-shaped bracket 96 near the center of the strut 94. While a single roller 38 is shown in FIG. 2, a pair of such rollers 38 are shown in spaced relationship on the shaft 114 in FIG. 1B. The gear 112 is coupled to a suitable drive motor (not shown) for rotating the shaft 114 and the pair of rollers 38.

The lower conveying apparatus includes the roller 40 and the supporting structure 44 (FIG. 2). The supporting structure 44 comprises a right carriage 116 and a left carriage 118 (FIG. 1B), the carriages being slidable along respective guide rods or shafts 120 and 122 which are fixed to end walls 50 and 52 (FIG. 1A). The guide rods 120 and 122 are parallel to the guide rods 104 and 106 and the carriages 116 and 118 are moved along such guide rods 104 and 106 by a driving wire or cable 124 which is secured to a bracket or connector 126 (FIG. 1A) on the side of the right carriage 116. The driving wire 124 is coupled to and operated by controlled rotation of a stepper motor (not shown). A U-shaped bracket 128 (FIG. 1B) is secured to the carriages 116 and 118 and carries a shaft 134. A swinging bracket 130 is pivotally supported on a shaft 132 journaled on the bracket 128. A pressure roller 136 and an idler roller 138 are attached to both ends of the swinging bracket 130. The pressure roller 136 is journaled on the shaft 132 and the idler roller 138 is journaled on a shaft 140 which is pivotally supported by a U-shaped bracket 142. The idler roller 138 is engageable with and rides on the top surface of a shift plate 144 (FIG. 1A) as the carriages 116 and 118 slide along the guide rods 120 and 122. The shift plate 144 is positioned in parallel manner with the guide rods 120 and 122. A plurality of studs 146 are fixed to the shift plate 144 at spaced locations along the length of the plate. A pair of arms 148 are pivotally connected at one end thereof to the respective studs 146. An arm 150, located to the right side of the arms 148 (FIG. 1B), is also pivotally connected to a stud 146 on the shift plate 144 (FIG. 1A).

A shaft 152 is journaled in a bracket 154 and the other end of the arm 150 is journaled on the shaft 152 (FIG. 1A). A pair of shafts 156 are journaled in the brackets 158 and the other end of the arms 148 are journaled on the shafts 156, respectively. The arms 148 and 150 are urged to be rotated in the direction of the arrow 160 by a spring 162 connected to an arm 164 and to a suitable frame portion of the enclosure 46. The shift plate 144 is urged by the spring 162 to be raised to the phantom position, as shown in FIG. 1A.

When the shift plate 144 is raised, the idler roller 138 riding on the top surface of the shift plate (FIG. 1A) is raised which effects rotation of the swinging bracket 130 in a clockwise direction about the shaft 132. When the swinging bracket 130 is rotated in the clockwise direction, the pressure roller 136 at the other end of the swinging bracket is raised. In this regard, the pressure roller 136 can move while maintaining a predetermined height or while applying a predetermined pressure on the page turning roller 38. If the page turning roller 38 of the upper conveying apparatus comes into alignment with the center of the shaft 134, the pressure roller 136 grips the record medium 18. If the page turning roller 38 does not move into alignment with the center of the shaft 134, the pressure roller 136 raises the record medium 18. A stud 166 is fixed to the arm 164 and a solenoid (not shown) is used to actuate the arm 164 and to move the shift plate 144 to the original position (FIG. 1A). The movement of the arm 164 is in a direction opposite the arrow 160 and against the urging of the spring 162.

The moving distance of the upper conveying apparatus and of the lower conveying apparatus is determined by the number of steps counted from a home position by a sensor (not shown). The number of steps required for each moving operation of the conveying apparatus is set at a predetermined number by a controller (also not shown).

A page turning operation using the conveying apparatus and the rollers 30–40 is described with reference to FIGS. 2, 3A–3E, and 4A–4E. When a record medium 18, such as a passbook in the open condition, is inserted at the entrance port 22, the passbook is conveyed by the gripping apparatus 24 along the feed path toward the printing mechanism 10 at the printing station. The passbook 18 is then handed over to the rollers 30 and 32 which position the passbook for gripping by the rollers 38 and 40. The passbook 18 is transported by the rollers 38 and 40 to the proper position for printing on a line or lines by the print head 14 at the printing station. At the completion of the printing operation, the passbook is conveyed by the rollers 30 and 32 and by the gripping apparatus 24 to the entrance port 22 to be discharged from the machine. The printing operations are performed in the above manner until all lines on a page of the passbook have been printed.

Figure 3A:
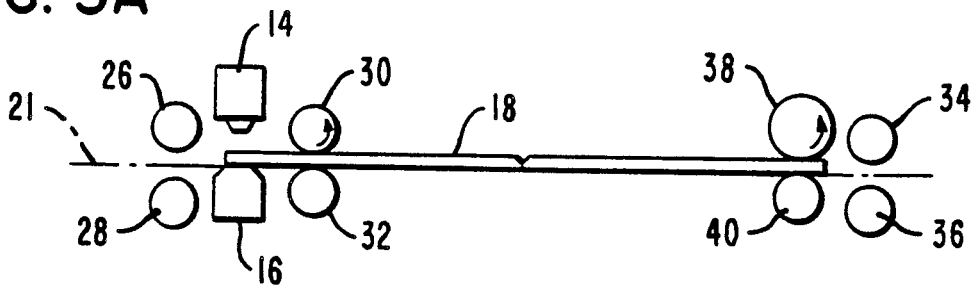
FIGS. 3A–3E, inclusive, are side views in schematic form showing a passbook forward page turning operation.
Figure 3B:
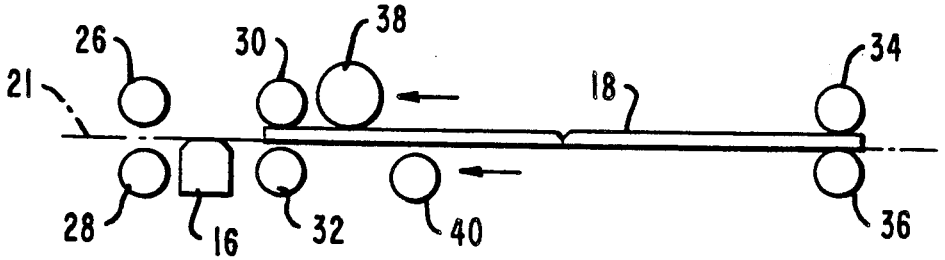

FIGS. 3A–3E illustrate in schematic form a page turning operation. When the last line on a page is printed and additional printing is required to complete the transaction, it is necessary to turn to the next page of the passbook 18. As seen in FIG. 3A, the passbook 18 is positioned wherein printing has been accomplished on the last line of the passbook 18 by the print head 14 associated with the platen 16. The rollers 38 and 40 are positioned at a distance from the printing station and are aligned in the vertical direction and grip one end of the passbook 18 while the rollers 30 and 32 grip the passbook 18 near the other end thereof and are positioned adjacent the printing station. When the conveying apparatus or rollers 38 and 40 reach the last stop or last line printing position while gripping the passbook 18, the roller 30 and the roller 38 are rotated in a counterclockwise direction which drives the passbook 18 to the rollers 34 and 36. The rollers 34 and 36 grip the end of the passbook 18 to set the passbook in position for a page turning operation. The roller 40 is moved away or displaced from the roller 38 and such rollers 40 and 38 are moved to predetermined positions for a page turning operation (FIG. 3B).

Figure 3C:
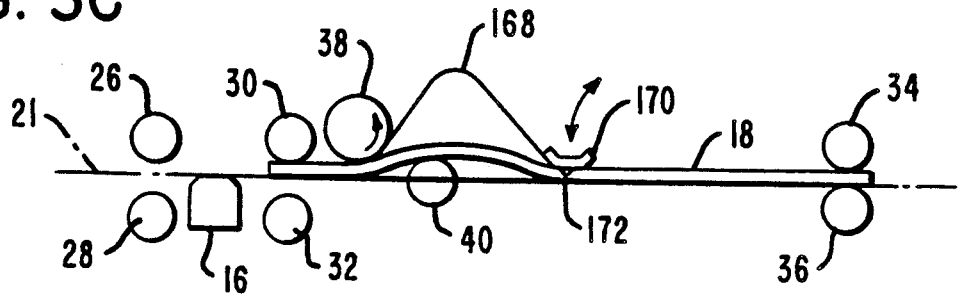
Figure 3D:
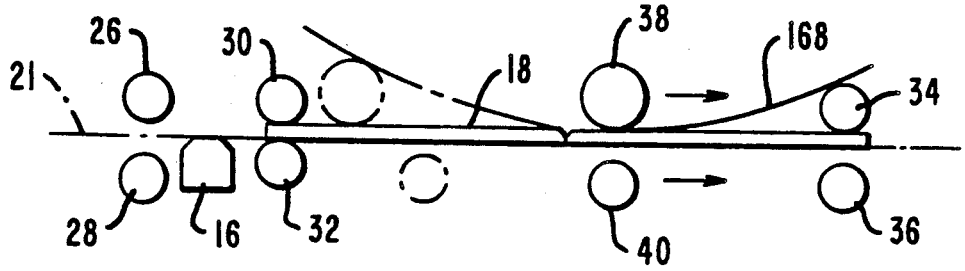
Figure 3E:
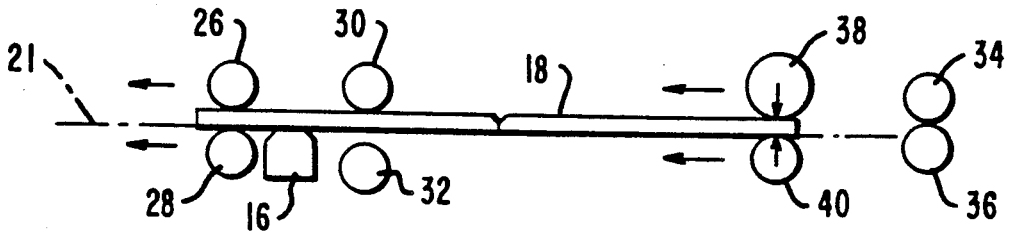

As shown in FIG. 3C, the roller 40 is moved upwardly to deform the passbook 18. In this regard, since the passbook 18 is moved to the right for printing on the respective lines, the lower portion of the passbook is raised for turning a page 168 thereof. The roller 38 is rotated in a counterclockwise direction against the page 168 to initiate turning thereof while a press pad or like member 170 may be used to hold the passbook 18 at the fold 172 thereof. The press pad 170 may be swung toward and from the fold 172 in the passbook 18 as shown by the arrow. After the page 168 is turned up by the roller 38, the roller 32 is moved up and the rollers 30 and 32 grip the passbook 18. When the page 168 is turned up to the phantom line position (FIG. 3D), the rollers 38 and 40 are moved toward the right and the page 168 is then placed over the top of roller 34. The roller 30 is rotated clockwise to then move the passbook 18 toward the left while the rollers 38 and 40 grip the passbook and are moved therealong. The passbook 18 is gripped by rollers 26 and 28 while roller 32 is lowered to permit the passbook to be moved toward the left in FIG. 3E for a printing operation. The rollers 38 and 40 are gripping the passbook 18 while moving toward the printing station and the roller 36 is moved up against roller 34 after exiting of the passbook.

Figure 4A:
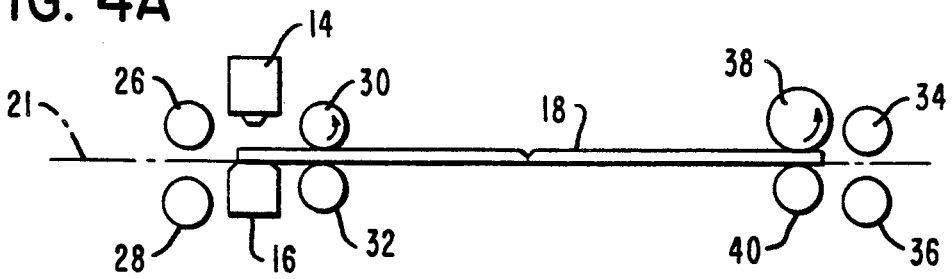
FIGS. 4A–4E, inclusive, are side views in schematic form showing a passbook backward page turning operation.

FIGS. 4A–4E illustrate in schematic form a page turning back operation. When too many pages of the passbook 18 have been turned or it is necessary to print data on the previous page, the structure of the present invention enables turning back a page of the passbook 18. A page mark may be read to indicate that too many pages have been turned and the instant page is not the next successive page to be printed. The rollers 38 and 40 grip the passbook 18 as it is moved toward the right for printing on the last line. When the rollers 38 and 40 have moved the passbook 18 to the last stop of the passbook position, the rollers 30 and 32 grip the passbook, as shown in FIG. 4A. In simultaneous manner, the roller 30 and the roller 38 are rotated counterclockwise to set the passbook 18 for a page turning back operation.

Figure 4B:
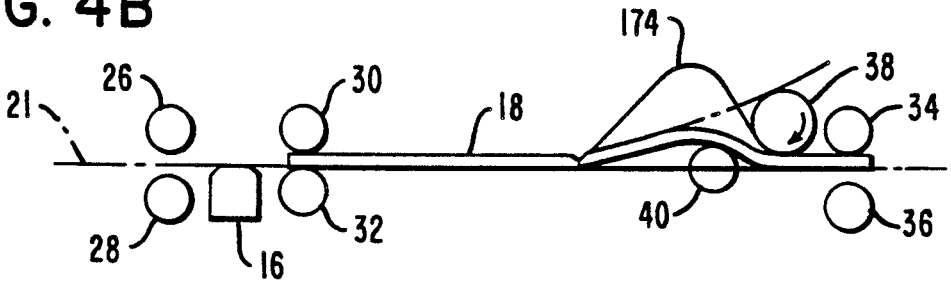
Figure 4C:
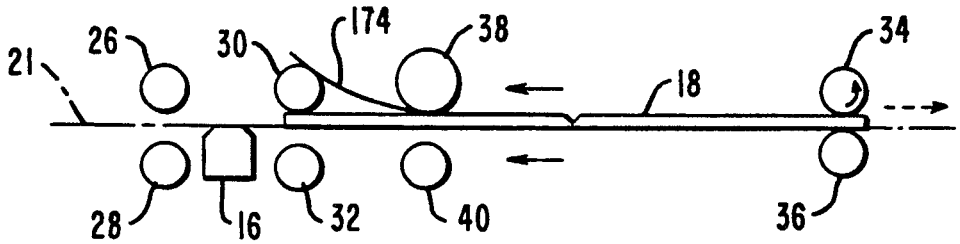
Figure 4D:
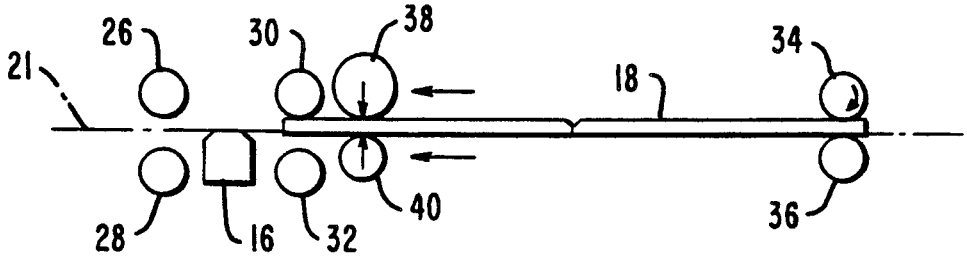
Figure 4E:
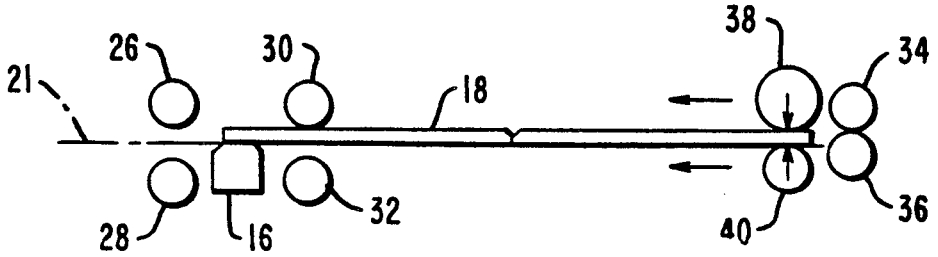

The roller 40 is displaced from a position under roller 38 toward the left in FIG. 4B by a predetermined distance and then is moved upwardly to deform the passbook 18. In this regard, since the passbook 18 has been moved to a right position from the printing station, the upper portion of the passbook is raised for turning a page 174 thereof. When the roller 38 is rotated counterclockwise to turn up the page 174, the rollers 34 and 36 immediately grip the passbook 18 in order to prevent turning more than one page. When the page 174 has been turned up to the phantom line position (FIG. 4B), the roller 40 is lowered and the rollers 38 and 40 are moved toward the left and the page 174 is placed over the top of the roller 30 (FIG. 4C). The passbook 18 is moved a limited distance to the right by rollers 34 and 36 to enable the page 174 to be disposed under the roller 30. The rollers 38 and 40 then grip the passbook 18 for handing the passbook over to rollers 30 and 32 (FIG. 4D). The roller 40 is lowered from roller 38 and then the rollers 38 and 40 are moved to the right position and grip the passbook 18 (FIG. 4E). The rollers 38 and 40 then move the passbook 18 toward the printing station for printing operation.

Certain alternatives mentioned herein include the amount that the roller 40 is moved upwardly to deform the passbook 18 which amount may depend on the flexural rigidity of the passbook. Another alternative is the rotation of the roller 38 for initiating a page turning operation while the roller 40 is moving upwardly to deform the passbook 18. In regard to the page turning step of FIG. 3D wherein the roller 38 is used to lay down the page 168, an additional alternative may be the moving of the passbook 18 to the printing station and the page 168 may be pressed down by the roller 30.

Figure 5A:
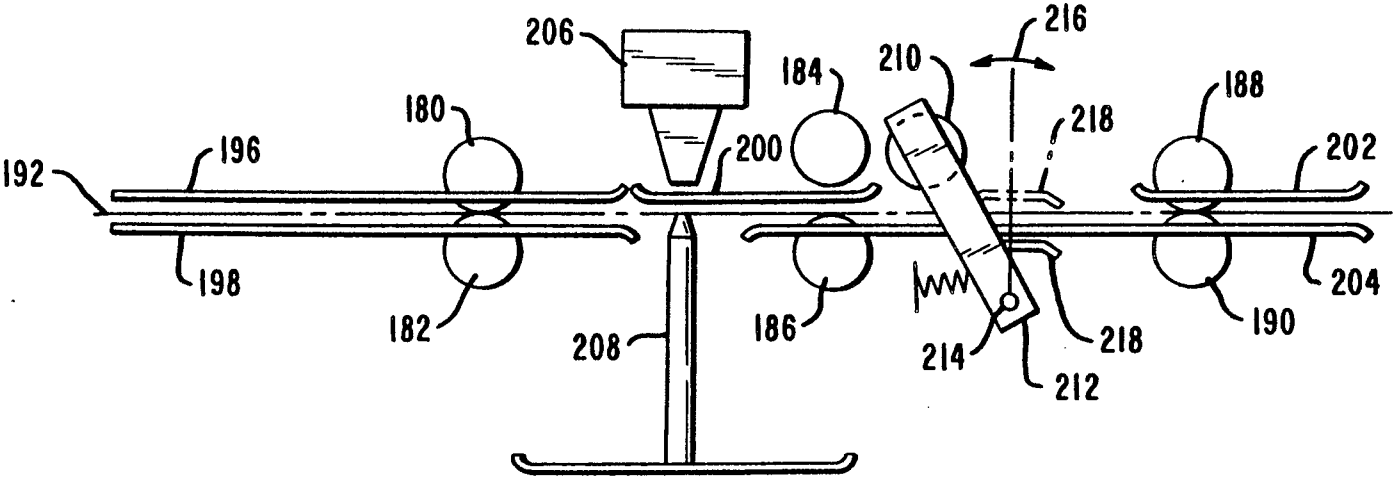
FIG. 5A, on the sheet with FIG. 2, is a side view in schematic form showing conventional page turning apparatus.
Figure 5B:
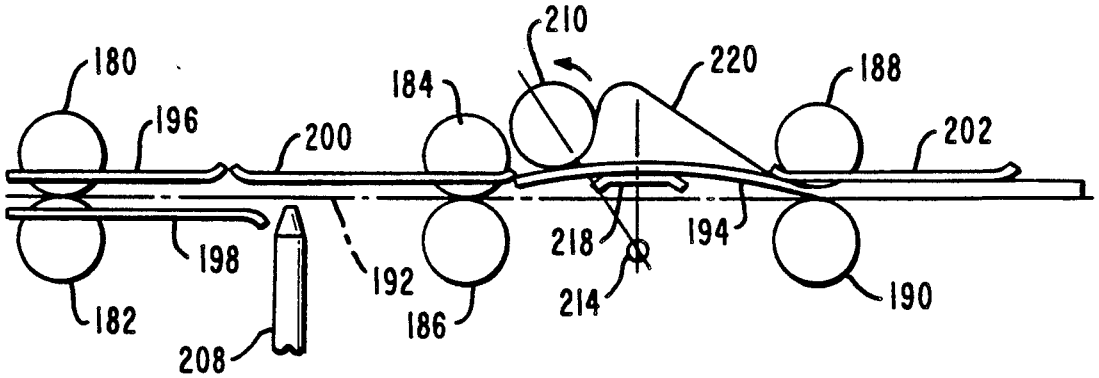
FIG. 5B PRIOR ART
FIG. 5B is a side view in schematic form showing a conventional forward page turning operation.
Figure 5C:
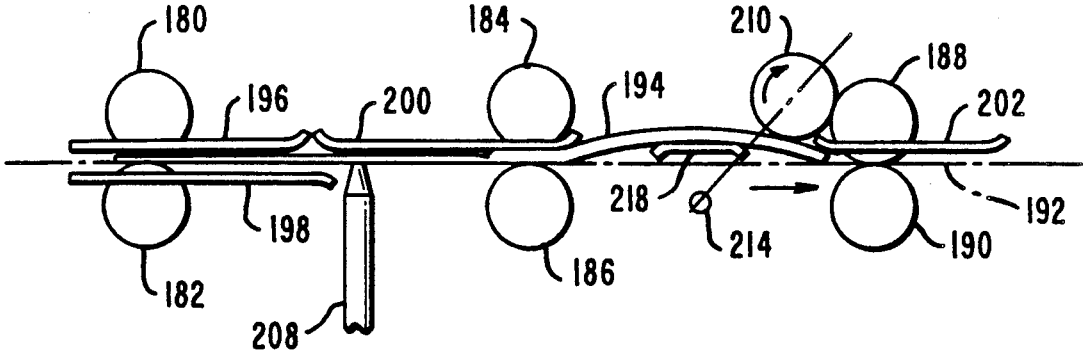
FIG. 5C PRIOR ART
FIG. 5C is a side view in schematic form showing a conventional backward page turning operation.

A conventional page turning structure is shown in FIGS. 5A–5C and is described in Japanese Laid Open Patent Specification No. 20497/83. The conventional structure includes feed rollers 180, 182, 184, 186, 188 and 190 disposed along a feed path 192 for a passbook 194 (FIG. 5B). A plurality of guide members 196, 198, 200, 202 and 204 are likewise disposed along the feed path 192 for the passbook 194. The guide member 200 is movable along the feed path 192 so as to span the distance from a printing station to a page turning station during a printing operation and so as to span the distance from the page turning station to the printing station during a page turning operation.

A print head 206 (FIG. 5A) is provided between the feed rollers 180 and 184 and a platen 208 is placed in a position opposed to the print head at the printing station. A page turning roller 210 is provided at the page turning station between the rollers 184 and 188 and is attached to the upper end of a swing lever 212. The swing lever 212 is connected to a drive shaft 214 which moves the lever in a swingable path, as indicated by the arrow 216. A press pad 218 is provided between the feed rollers 186 and 190 and is movable in a vertical direction from one position to another position, as shown in phantom line.

A forward page turning operation is shown in FIG. 5B. When the passbook 194 is conveyed along the feed path 192 and is guided by the guide members 196, 198 and 200 in the open condition to the printing station, the guide member 200 is moved so as to enable the printing operation. In the case wherein the last line on a page 220 has been printed and additional data is required to be printed on the next page to complete the transaction, the passbook 194 is guided by the guide member 200 to the page turning station.

When the guide member 200 is moved to the printing station, the press pad 218 is raised and moves the rear or bottom portion of the passbook 194 to a curved position wherein the page 220 to be turned is pressed against the roller 210. The page turning roller 210 is rotated counterclockwise to turn up the page 220 and the pad 218 is then lowered and the passbook 194 is fed toward the printing station. The guide member is forced to move in order to enable the printing operation.

In case one too many pages have been turned, it is necessary to turn back one page to the proper page of the passbook 194. The passbook 194 is fed to the page turning section and is positioned so that the front or upper portion of the passbook is over the press pad 218 (FIG. 5C). The page turning roller 210 is swung by the lever 212 into position wherein the page to be turned back is pressed against the roller 210. At the time of swinging of the lever 212 and the roller 210, the press pad is raised up to position the page to be turned against the roller 210. The page turning roller 210 is rotated clockwise to turn up the page and the passbook 194 is moved a limited distance toward the right to complete the turning back of the page. The passbook 194 is then fed to the printing station by the rollers 184 and 186.

The conventional structure uses the guide member 200 which must be moved to and from the printing station or to and from the page turning station to enable the respective operations. This structure is complicated and costly. Additionally, when the passbook 194 is positioned to turn back a page thereof, it is necessary to feed the passbook a sufficient distance corresponding to the length of the open book to enable a page turning back operation so that the size of the structure must be large to enable such operation.

The present invention provides upper and lower conveying or transporting rollers in a page turning area or section of the business machine wherein the rollers are movable independently of each other, and opposed rollers are provided at both ends of the page turning area for gripping and conveying the passbook or like record medium. The conveying rollers grip the passbook and are moved in synchronism to convey the passbook to the desired location. When a page is to be turned, the conveying rollers are moved to respective predetermined positions, the lower roller is raised to deform the passbook and the upper roller is displaced and then rotated to complete the page turning operation.

It is thus seen that herein shown and described is a passbook page turning mechanism having upper and lower transporting rollers which grip the passbook and are movable independently of each other to turn a page of the passbook and such rollers occupy a minimum amount of space for the operation.

The structure and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A page turning mechanism for a multiple-page record medium in a printer having means for feeding said multiple-page record medium along a feed path to a page turning station, said page turning mechanism comprising a first movable roller and a second movable roller positioned at said page turning station, said first and second rollers being movable in a first direction parallel to said feed path to predetermined positions, means to rotate said first roller to turn up a page of said record medium, means for mounting said second roller for displacement from said first roller in said first direction parallel to said feed path and then for movement in a second direction perpendicular to said feed path toward said record medium so as to effect a bowed condition thereof, said first roller being movable from said predetermined position in a direction opposite said first direction parallel to said feed path for completing the turning of one page of said record medium.

2. The mechanism of claim 1 wherein said first roller and said second roller are movable in synchronism along said feed path, said first roller being of different diameter than said second roller and also being movable independently of said second roller.

3. The mechanism of claim 1 including a pair of opposed rollers at one end of said page turning station and a pair of opposed rollers at the other end of said page turning station for holding said record medium during a page turning operation.

4. The mechanism of claim 1 wherein said first roller and said second roller comprise an upper roller and a lower roller, said upper roller being larger in diameter than said lower roller and having a frictional coating on a portion of the circumference thereof for engaging with a page of said record medium for turning said page upon rotation of said upper roller.

5. In a printer having a print head and a platen associated therewith for printing on a record medium having a plurality of pages, and means for feeding the record medium along a feed path from an entrance of said printer to a page turning station, the improvement comprising a page turning mechanism at said page turning station, said page turning mechanism including a first movable roller and a second movable roller, said first and second rollers being movable parallel to said feed path in a first direction to predetermined positions means for rotating said first roller to initiate the turning of a page of said record medium, means for mounting said second roller for displacement from said first roller in said first direction parallel to said feed path and then for movement in a second direction perpendicular to said feed path toward said record medium so as to effect a bowed condition thereof, said first roller being movable from said predetermined position in a direction opposite said first direction parallel to said feed path while engaging a page of said record medium in the bowed condition thereof for completing the turning of said page.

6. In the printer of claim 5 wherein said first roller and said second roller are movable in synchronism along said feed path, said first roller being or different diameter than said second roller and also being movable independently of said second roller.

7. In the printer of claim 5 including a pair of opposed rollers at one end of said page turning station and a pair of opposed rollers at the other end of said page turning station for holding said record medium during a page turning operation.

8. In the printer of claim 5 wherein said first roller and said second roller comprise an upper roller and a lower roller, said upper roller being larger in diameter than said lower roller and having a frictional coating on a portion of the circumference thereof for engaging with a page of said record medium for turning said page upon rotation of said upper roller.

* * * * *